US005196983A

United States Patent [19]

Stumpf

[11] Patent Number: 5,196,983

[45] Date of Patent: Mar. 23, 1993

[54] SOLENOID ENGAGEMENT SENSING CIRCUIT

[75] Inventor: Paul B. Stumpf, Rochester, N.Y.

[73] Assignee: Eastman Kodak Company, Rochester, N.Y.

[21] Appl. No.: 772,525

[22] Filed: Oct. 7, 1991

[51] Int. Cl.[5] ..... H01H 47/32

[52] U.S. Cl. ..... 361/154; 361/160; 361/187; 324/207.16; 324/207.24; 324/654; 324/418; 340/644

[58] Field of Search ..... 361/152-154, 361/160, 170, 187, 203, 205; 307/112, 116, 143; 324/418, 424, 207.15, 207.16, 207.24, 654-656; 340/638, 644, 686, 687

[56] References Cited

U.S. PATENT DOCUMENTS 4,851,959 7/1989 Stumpf ..... 361/159
4,950,985 8/1990 Voss et al. ..... 324/207.16
4,970,622 11/1990 Buchl ..... 361/154
4,981,173 1/1991 Perkins et al. ..... 166/66.4
5,053,911 10/1991 Kopec et al. ..... 361/154

*Primary Examiner*—A. D. Pellinen
*Assistant Examiner*—David Osborn
*Attorney, Agent, or Firm*—William F. Noval

[57] ABSTRACT

A shutter, positioned between an electronic imaging device (such as a laser printer) and a film processor, is actuated by a solenoid which is driven by a driver network which isolates the solenoid coil when it is deactuated. If, after deactuation, a jam occurs, such that the shutter does not close completely, the jam is detected by a solenoid engagement sensing circuit. The sensing circuit includes a function generator, an operational amplifier having the solenoid coil connected between its input and output, an envelope detector and a comparator. The comparator produces a jam signal in response to an increase in the voltage detected by the presence of the solenoid plunger within the solenoid coil.

4 Claims, 4 Drawing Sheets

SOLENOID ENGAGEMENT SENSING CIRCUIT

BACKGROUND OF THE INVENTION

This invention relates in general to the sensing of jams in electromechanical systems utilizing solenoids. More particularly, this invention relates to a solenoid engagement sensing circuit which senses a jam in a solenoid actuated shutter positioned between an electronic imaging device and a film processor.

Electromechanical systems utilizing solenoid actuated mechanisms are widely used in industry. In such systems it is desirable to determine if a mechanical and/or electrical failure has occurred in the solenoid actuated mechanism so that appropriate action can be taken to prevent damage to the system. Commercially available sensors are employed utilizing various techniques (such as optical or inductive proximity) for sensing mechanical position. These devices typically require additional wiring and bracketry which can adversely affect cost and reliability of the system. The following U.S. Patents disclose various solenoid actuated electromechanical systems which have solenoid sensing arrangements which are disadvantageous for one or more of the following reasons, i.e. undo complexity, excessive cost, unreliability, excessive space requirements, undesirable power consumption. U.S. Pat. No. 4,868,709, issued Sept. 19, 1989, inventor H. Aoki; U.S. Pat. No. 4,905,121, issued Feb. 27,1990, inventor T. Uetsuhara et al; U.S. Pat. No. 3,857,081, issued Dec. 24, 1974, inventor E. F. Gebelerein, Jr.; U.S. Pat. No. 4,205,307, issued May 27, 1980, inventors P. Liermann et al.; U.S. Pat. No. 3,678,344, issued July 18, 1972, inventor W. R. Wedmore; U.S. Pat. No. 4,456,943, issued June 26, 1984, inventor M. S. Judy; U.S. Pat. No. 4,661,766, issued Apr. 28, 1987, inventors J. P. Hoffman et al.; U.S. Pat. No. 4,967,309, issued Oct. 30, 1990, inventor J. P. Hoffman; U.S. Pat. No. 4,387,306, issued June 7, 1983, inventor H. C. Sibley; U.S. Pat. No. 4,538,203, issued Aug. 27, 1985, inventors P. D. Flanner et al.; U.S. Pat. No. 2,600,317, issued June 10, 1952, inventor G. W. Nagel.

Commonly assigned U.S. Pat. No. 4,851,959 discloses a useful technique for sensing jams in electromechanical systems involving solenoids. As disclosed in this patent, a disk memory library includes picker arms operated by a solenoid to remove a selected disk from a library stack of disks and to place the disk in a reading/writing environment. The solenoid plunger's position is determined by sensing its effect on a series resonant circuit including the solenoid coil and a series capacitor. A function generator provides a triangular signal to the solenoid coil. A threshold detector and synchronous detector determine when the plunger is in or out and, in turn, when the picker arms are extended or retracted. Although the solenoid engagement sensing circuit of the latter patent is useful for the purposes for which it is intended, it would be desirable to provide a solenoid engagement sensing circuit which has fewer components, which operates at higher frequencies and which is lower in cost.

SUMMARY OF THE INVENTION

According to the present invention, there is provided a solenoid engagement sensing circuit which is simple in construction, low in cost, reliable, and which is operable at high frequencies to quickly detect solenoid jams. The sensing circuit is effective in sensing whether or not a jam occurs in a solenoid actuated shutter positioned between an electronic imaging device and a film processor.

According to an aspect of the present invention, a solenoid linked to a shutter, includes a coil and a movable plunger. The solenoid is actuated in response to an actuation signal. A solenoid engagement sensing circuit detects whether or not the solenoid plunger is completely removed from the coil after deactuation. The solenoid coil is driven by a solenoid driver network which decouples and isolates the solenoid coil when the solenoid is deactuated. According to a feature of the present invention, a solenoid engagement sensing circuit includes an operational amplifier, a function generator, an envelope detector and a comparator. The solenoid coil is connected between the input and output of the operational amplifier. The function generator supplies a periodic signal (such as a triangle wave) to the input of the operational amplifier. A change in inductance of the solenoid coil caused by different positions of the plunger within the solenoid coil causes gain changes in the operational amplifier and resultant changes in amplitude of the output signal from the amplifier. The peaks of the output signal are detected by the envelope detector circuit and converted to a DC voltage. This DC voltage is then compared by the voltage comparator to a threshold voltage which is representative of a plunger "out" condition. If the threshold voltage is exceeded, a plunger "in" condition is detected and a solenoid jam signal is produced.

DESCRIPTION OF THE PREFERRED EMBODIMENTS

Figure 1:
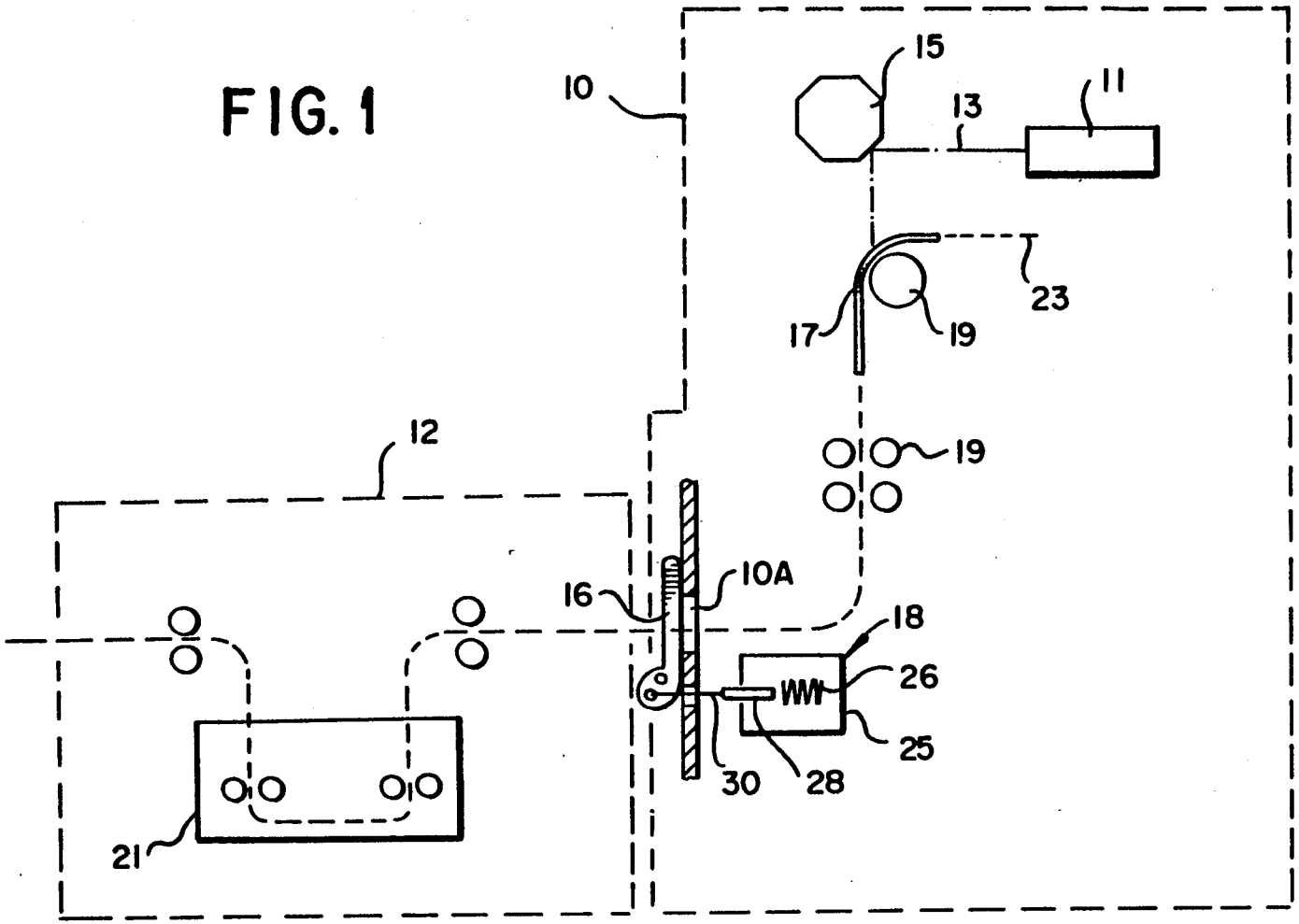
FIG. 1 is a diagrammatic view of apparatus incorporating an embodiment of the present invention.

Referring now to FIG. 1, there is shown apparatus incorporating an embodiment of the present invention. As shown, a laser imaging device, such as radiographic laser printer 10, produces a latent x-ray image in a sheet of film. The laser imaging device may, for example, be the laser printer supplied by the Eastman Kodak Company, Rochester, New York, under the name "Kodak Ektascan Laser Printer". This device includes a laser scanner which converts a digital x-ray image received from a medical diagnostic imaging modality (CT, MRI, US, PET) into a latent image on film. A modulated laser 11 produces beam 13 which is scanned by polygon scanner 15 laterally across a sheet of film 17 as it is transported by drum 19 along path 23. The exposed film 17 is then transported by rollers 20 out of printer 10 to x-ray film processor 12. Processor 12 develops the latent image on the film 17 into a visible x-ray image by transporting film 17 through tank 21 of processing fluids. Because such processing fluids produce vapors that can be corrosive to sensitive components of laser printer 10, printer 10 is provided with a shutter 16 which minimizes the passage of corrosive vapors into laser printer 10 from processor 12. Shutter 16 is in a normally closed position, but is moved to an open position by solenoid assembly 18. Assembly 18 opens shutter 16 when film 17 is transferred from printer 10 to processor 12 for developing of film 17. The shutter 16 is opened for a short period to permit transfer of film 17 to processor 12. The shutter 16 is then closed to minimize passage of corrosive vapors from processor 12 to printer 10.

Figure 4A:
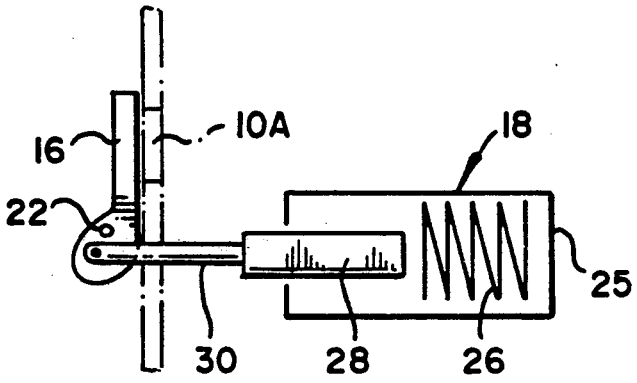
FIGS. 4*a*, 4*b* and 4*c* are diagrammatic elevational views illustrating operation of the embodiment of FIG. 2 as used in the apparatus of FIG. 1.
Figure 4B:
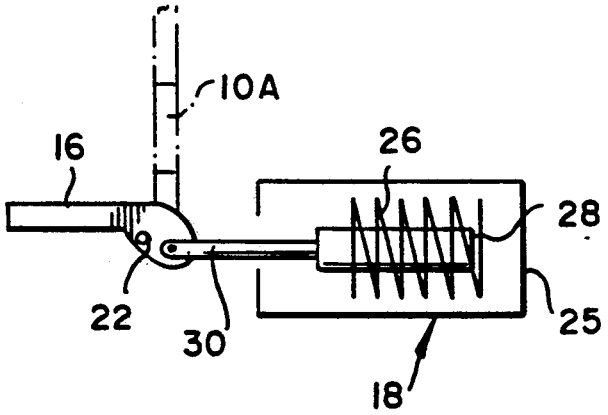

As shown in FIG. 4*a*, shutter 16 rotates about pivot 22 and is biased to a closed position by a spring (not shown) to close off exit opening 10A of printer 10. Solenoid assembly 18 includes solenoid 25 having coil 26 and a plunger 28 mechanically linked to shutter by means of linkage 30. In the closed position of shutter 16 shown in FIG. 4*a*, plunger 28 is displaced from coil 26. As shown in FIG. 4*b*, when coil 26 is actuated, plunger 28 is drawn into coil 26 moving linkage 30 and shutter 16 against the biasing force of the spring. Exit opening 10A is uncovered for a short period to permit passage of an exposed x-ray film 17 from printer 10 into processor 12. When film 17 has completely passed from printer 10, solenoid coil 26 is de-energized and the spring returns shutter 16 to a closed position, blocking exit opening 10*a* (FIG. 4*a*).

Figure 4C:
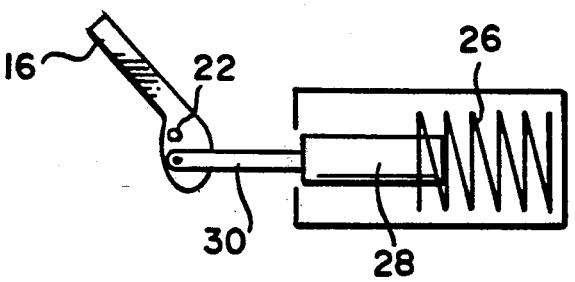

In the event of a broken linkage 30, shutter 16 would most likely close under tension of the spring. However, (as shown in FIG. 4*c*) in the event of a jam in the linkage 30 after the solenoid coil 26 is deactuated, plunger 26 partially extends into coil 28 and sensing of the jam condition is effected by the solenoid engagement sensing circuit of the present invention.

Figure 2:
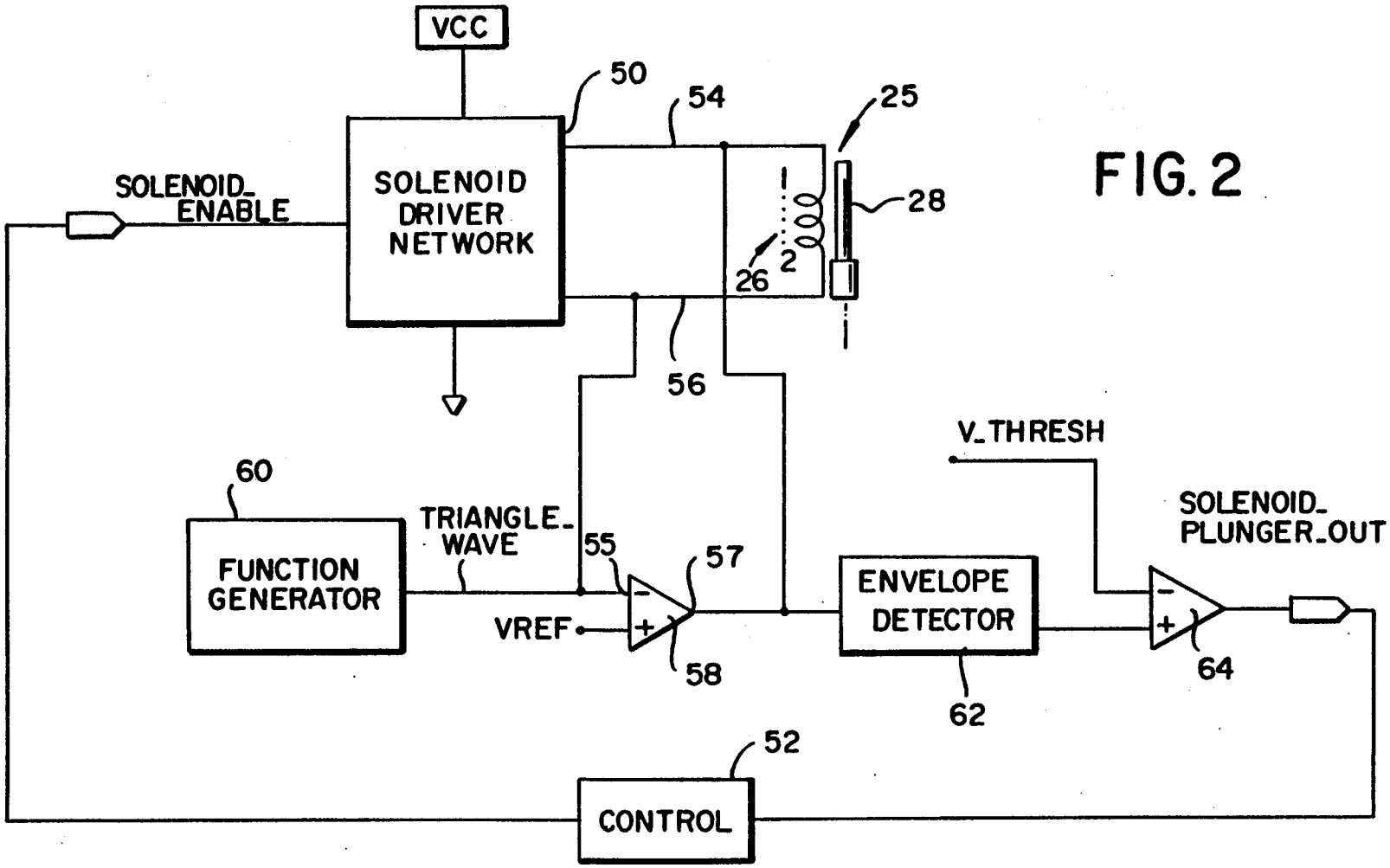
FIG. 2 is a block diagram of an embodiment of the solenoid engagement sensing circuit of the present invention.
Figure 3:
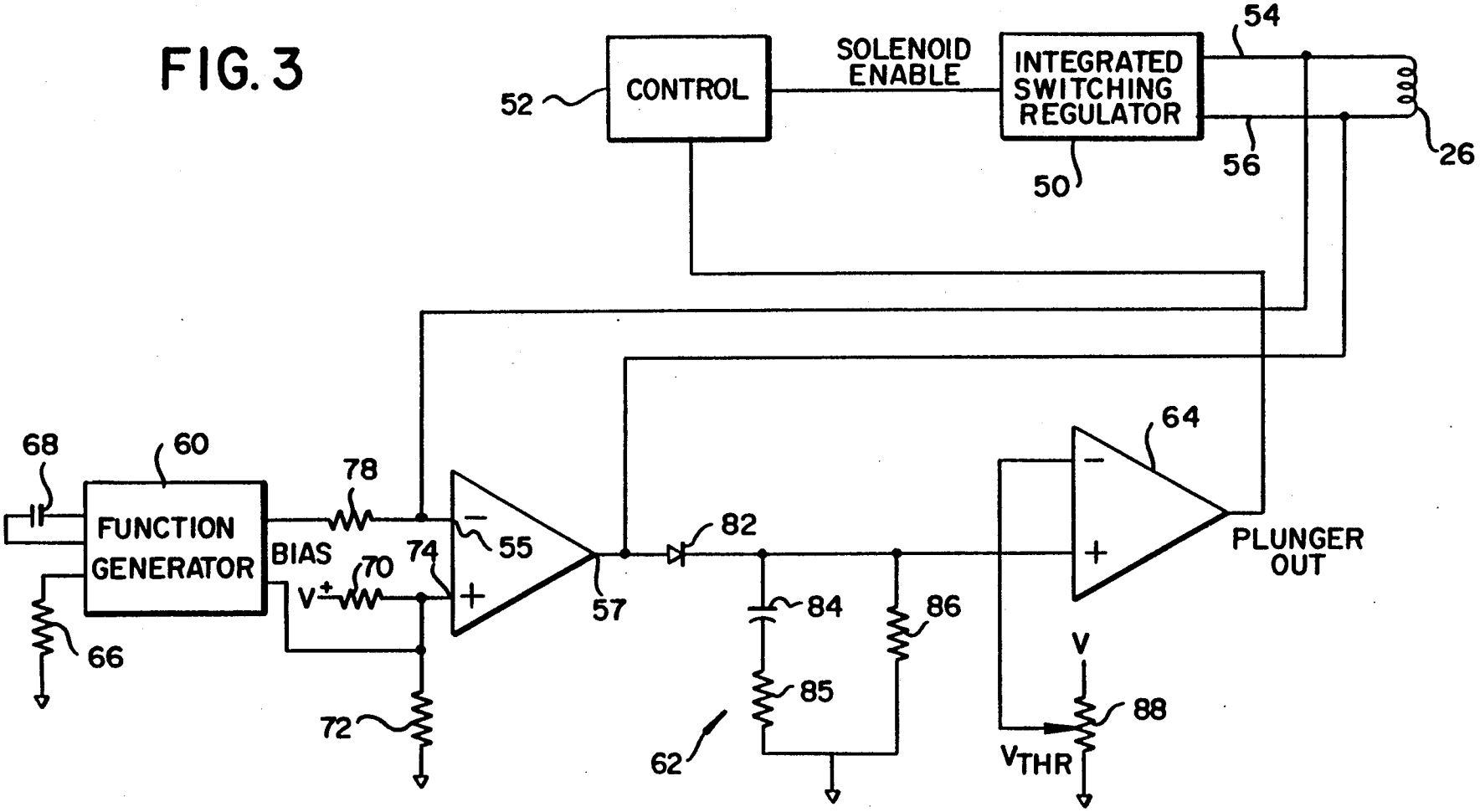
FIG. 3 is a detailed schematic diagram of the embodiment of FIG. 2.

Referring now to FIGS. 2 and 3, there is shown a preferred embodiment of the solenoid engagement sensing circuit of the present invention. As shown, solenoid coil 26 is actuated by a solenoid driver network 50 upon receipt of a solenoid enable signal from control circuit 52. Network 50 actuates solenoid coil in the energized state and decouples and isolates terminals 54 and 56 of solenoid coil 26 in a de-energized state. Solenoid coil 26 is connected between the input 55 and output 57 of operational amplifier 58. Function generator 60 supplies a periodic signal, such as a triangle wave, of some convenient frequency, to input 55 of amplifier 58. The change in inductance of solenoid coil 26, caused by different positions of plunger 28 relative to solenoid coil 26, produces gain changes in amplifier 58 which result in changes in amplitude of the output signal of amplifier 58. Output peaks of the triangle wave signal from amplifier 58 are detected by envelope detector circuit 62 and converted to a DC voltage. This DC voltage is then compared by comparator 64 with a threshold voltage which is representative of plunger 28 being completely out of coil 26. If after deactuation of solenoid 25, a jam occurs the plunger 28 is at least partially within coil 26 (see FIG. 4*c*), and the gain of amplifier 58 is increased to produce an amplified output signal. The peak voltage detected by detector 62 exceeds the threshold voltage, and comparator 64 produces a jam signal which is applied to control circuit 52 for further processing (such as producing a warning signal to an operator).

Referring now to FIG. 3, there is shown a schematic diagram of the circuit of FIG. 2. As shown, solenoid driver network 50 for energizing solenoid coil 26 is an integrated switching regulator 50 such as part L295 supplied by SGS/Thomson Corporation. This regulator 50 uncouples and isolates terminals 54 and 56 of the solenoid coil 26 when de-energized. Thus, solenoid coil 26 can function as a feedback element between the input 55 and output 57 of operational amplifier 58 without undesirable side effects, which would be present if the terminals were not uncoupled. As an alternative, a linear switching circuit using a transistor bridge circuit would also work well as a solenoid driver circuit.

Function generator 60 is an EXAR XR2209 component, which is capable of producing a triangle wave with a frequency set by resistor 66 and capacitor 68. The peak to peak value of the output of function generator 60 can, for example, be approximately 20 volts. The bias of generator 60 is set by a voltage divider network including resistors 70 and 72 connected between ground and a V+ power source. This bias also establishes the reference for operational amplifier 58 and is input to the positive terminal 74 of amplifier 58. Amplifier 58 is a general purpose operational amplifier such as the component designated MC4741. The output of function generator 60 is applied to the negative terminal 55 of amplifier 58 by way of resistor 78. Coil 26 is connected in a feedback mode between input terminal 55 and output terminal 57 of amplifier 58. As plunger 28 is moved in and out of coil 26, the inductance of coil 26 changes. Such inductance change results in a change in the gain of amplifier 58 and consequently in a change in the output signal at output terminal 57. For example, for a solenoid of interest, the approximate change in peak to peak voltage of the output triangle wave at output terminal 80 of operational amplifier 58 over the designed stroke range of plunger 28 is approximately 1 volt.

Envelope detector 62 includes diode 82, capacitor 84, and resistors 85 and 86. The frequency of the triangle wave generated by function generator 60 is chosen so that reasonable values of capacitor 84 can be used to effect rapid response of detector circuit 62.

Voltage comparator 64 is an integrated amplifier circuit such as the component designated LM339. A voltage threshold is applied to one input of comparator 64 and is set by variable resistor 88. The DC output voltage of envelope detector 62 is applied to the other input of comparator 64. The threshold voltage is set at a level slightly above the value of the peak voltage of the output of amplifier 58 when plunger 28 is in the out position. If a jam occurs after solenoid coil 26 is deactuated, plunger 28 will not be completely withdrawn from coil 26 (FIG. 4*c*) indicating that gate 16 is blocking exit opening 10A of printer 10. In such case, the peak voltage of the sensing signal exceeds the threshold voltage and comparator 64 produces a jam signal (PLUNGER OUT) which is supplied to control circuit 52.

INDUSTRIAL APPLICATIONS

The present invention finds application in equipment which include solenoid actuated electromechanical systems. The present invention is applicable, for example, to a laser imaging device having a solenoid actuated shutter at an opening for exiting laser exposed media.

It is understood by those skilled in the art that the foregoing description is of preferred embodiments of the disclosed invention and that various changes and modifications may be made in the invention without departing from the spirit and scope thereof.

What is claimed is:

1. A solenoid engagement sensing circuit comprising:

a solenoid having a coil and a plunger which is moveable into and out of said coil in response to an actuating signal;

means for applying an actuating signal to said coil and for electrically isolating said coil when no actuating signal is applied to said coil;

a generator for generating a periodic signal;

an operational amplifier having an input and an output, wherein said periodic signal is applied to the input of said amplifier, and said solenoid coil is connected between the input and output of said operational amplifier;

an envelope detector connected to the output of said amplifier for detecting and storing the peak value of the output signal from said operational amplifier; and a voltage comparator having an output and inputs connected to said envelope detector and to a reference threshold voltage, said voltage comparator being responsive to an increase in the voltage detected by said envelope detector as a result of a presence of said solenoid plunger within said coil to produce at said output a signal indicating the presence of said plunger within said coil.

2. The circuit of claim 1 wherein said envelope detector includes a diode, a capacitor and a resistor for detecting and storing the peak output signal from said operational amplifier.

3. The circuit of claim 1 wherein said generator generates a triangle wave signal.

4. The circuit of claim 1 wherein said applying means includes an integrated switching regulator circuit connected to said coil.

* * * * *